United States Patent [19]

Janowski et al.

[11] 3,997,341

[45] Dec. 14, 1976

[54] REDUCED TEMPERATURE SINTERING PROCESS

[75] Inventors: Kenneth R. Janowski, Wheaton; Charles J. Levesque, Elk Grove Village, both of Ill.

[73] Assignee: Universal Oil Products Company, Des Plaines, Ill.

[22] Filed: Oct. 17, 1974

[21] Appl. No.: 515,721

[52] U.S. Cl. ..... 75/211; 75/200; 75/222; 75/224; 148/126

[51] Int. Cl.[2] ..... B22F 3/00

[58] Field of Search ..... 148/126; 75/200, 211, 75/222, 224

[56] References Cited

UNITED STATES PATENTS

| | | | |
|---|---|---|---|
| 1,919,730 | 7/1933 | Koenig et al. | 75/222 |
| 3,266,936 | 8/1966 | Krebs | 75/DIG. 1 |
| 3,276,919 | 10/1966 | Todd | 148/126 |
| 3,462,260 | 8/1969 | Thafvelin et al. | 75/211 |

*Primary Examiner*—Brooks H. Hunt
*Attorney, Agent, or Firm*—James R. Hoatson, Jr.; Barry L. Clark; William H. Page, II

[57] ABSTRACT

Improved method of sintering a powder metal body at temperatures substantially lower than the normal sintering temperature of the metal. A body formed of powder metal particles is redox cycled by being repeatedly and alternately subjected to an oxidizing atmosphere and a reducing atmosphere. The number of redox cycles required to achieve sintering is inversely proportional to the temperature. The metal must be one which will undergo surface oxidation and reduction in the atmospheres and at the temperature used.

8 Claims, No Drawings

REDUCED TEMPERATURE SINTERING PROCESS

BACKGROUND OF THE INVENTION

This invention relates to the sintering of powder metallurgy parts. The consolidation of metal powders into usable forms is a technique that has been used for thousands of years. Until metal working technology developed to the point where temperatures sufficient to enable melting and casting were able to be readily attained, consolidation of metal particles into a finished form was the only way possible to produce relatively high melting point materials. Even today, many ceramics and refractory metals are consolidated almost exclusively by powder techniques rather than by melting and casting. As a fundamental consolidation and forming process, P/M (powder metallurgy) enjoys certain unique characteristics which result in microstructural advantages compared to melting, casting and conventional working processes. These include elimination of macro and micro segregation, elimination of directionality of structure and finer resultant grain sizes. The end products of these advantages are better and more homogeneous mechanical and physical properties and better dimensional stability. In addition, because P/M fabrication usually uses close tolerance dies, the ratio of usable to scrap material is substantially higher than for other fabrication techniques. Besides being able to control the microstructure, the alloy chemistry can also be held to very close tolerances, even with alloying constituents which have widely varying melting points. One final advantage of P/M fabrication is that the process lends itself to the production of parts of a low cost and with surfaces that require very little, if any, final machining.

The production techniques involved in P/M will be discussed below. It is obvious, however, that one of the limiting factors in the production of P/M parts is the equipment necessary to do the consolidation, i.e., the initial pressing of the "green" compact and the further densification by sintering. The technique of preforming followed by conventional forging obviates the need for the sintering step. However, it requires a powder consolidation step to fabricate the preform blank.

Current powder fabrication techniques involving both metals and non-metals can be divided into two areas: those involving pressure and those that are pressureless. In addition, those techniques involving pressure can be done either hot or cold. Cold pressure forming includes vibratory compacting, cyclic compacting, die compacting with or without binders, powder rolling, isostatic pressing and explosive forming. Of these techniques, the most common is die compacting. The most serious limitation that all of these cold compaction techniques share is the difficulty in bonding hard or coarse particles. The interparticle bond is formed by pressing the particles together. These particles may not adhere to each other if, for instance, they have a surface layer as, for example, aluminum of if the particles are hard as with tungsten. In addition, die compaction has the disadvantage of high die cost, limited press capability, high unit costs for small production runs and limits on part sizes and shapes as a result of non-uniform pressing pressures due to powder-die friction. Lubricants are often used to overcome the friction problems but they degrade the final product and are expensive to remove. One further disadvantage of pressing to form porous bodies, is that it is most desirable to use spherical powders of a single size; consolidation of this type of powder is the most difficult using powder pressing techniques. Hot pressure forming of powders includes hot pressing, hot forging, hot isostatic pressing and powder extrusion. Besides sharing some of the disadvantages of cold pressure forming, hot pressure forming generally requires very complex and expensive equipment. The one technique which uses more or less conventional equipment is hot forging where P/M preforms are press forged to final shapes. The preforms can be produced either by cold pressure or pressureless forming.

Pressureless forming techniques have been employed to produce a body with sufficient green strength to be further sintered or used as preforms. Such techniques include loose powder sintering, slip casting and slurry casting. Porous metal parts have often been produced by loose powder sintering. The temperatures may be high and the times long, however, to obtain a part with sufficient strength for the application, be it a porous metal part or a preform. Slip and slurry casting are techniques used in the ceramic industry which have not been widely used in P/M due to their slowness and relatively high cost.

Sintering is defined as the heating of a particulate body below the melting point of at least one major constituent so as to cause interparticle bonding. Sintering can result in chemical, dimensional or phase changes as well as stress relief and alloying. Considerable theoretical and experimental work has been done on the mechanisms of sintering. For metals, the most important sintering mechanism has been determined to be vacancy diffusion which results in material transport by either bulk or surface diffusion. In considering a sinterable body, one must consider the components of the system, namely the solid particulate phase and the void or pore phase. The end product of such a solid-pore system will depend upon whether bulk or surface diffusion takes place. This will affect the morphology of the porosity. In bulk diffusion, vacancies can migrate either through the lattice or along grain boundaries. The net flow of vacancies from the pores of a sintering body to the surface results in a decrease in pore volume and an overall densification. On the other hand, if vacancy diffusion occurs as a surface diffusion phenomenon, the shape of pores will change to spherical to minimize surface energy but the pore volume will not decrease. Therefore, to obtain high density, bulk diffusion must control sintering while surface diffusion must be the important mechanism if a porous structure is desired. It should be noted that viscous flow will be an important mechanism if pressure is applied, as in hot pressing. In this case, densification also occurs.

Three stages of sintering have been defined. In the first stage, neck growth between particles occurs, no grain growth takes place and total shrinkage is but a few percent. In the intermediate stage, some grain growth occurs, the pore phase is continuous or open, and all pores are intersected by grain boundaries. At 85 to 95% density, the porosity changes from open to closed which begins the final stage of sintering. Studies on the initial stage of sintering have been made by others on a wide variety of both metals and non-metals including Cu, Ag, NaCl, $Al_2O_3$, $Fe_2O_3$, AgI, $CaF_2$, NaF, Fe, Th and ice. In the metals, the initial sintering rate was found to be dependent upon the vacancy diffusion rate along grain boundaries. The greater the vacancy concentration and the finer the grain size, the more rapid the neck growth. In the intermediate sintering stage, pore shrinkage occurs resulting in an increased density as a function of sintering time and grain growth occurs with time as a function of $t^{1/3}$. The densification rate is found to be initially linear with time but then decreases as the sintering time is increased. It has been assumed that the sintering mechanism is still bulk diffusion as in the initial sintering stage but the grain boundary component of the bulk diffusion rate becomes increasingly more important. Based on this, it seems reasonable to assume that grain growth inhibition would keep the sintering rate high by keeping the number of grain boundaries available for vacancy diffusion from decreasing. Analysis of the final stage of sintering has been complicated by several effects. One of these is discontinuous grain growth which can be responsible for the cessation of shrinkage before all pores have been removed from the material. Discontinuous grain growth is a result of one large grain growing at the expense of its smaller neighbors. The boundaries sweep across pores enclosing them within the grains. Another complicating factor in final densification is trapped gas. If the closed pores contain ambient gas trapped as a result of pore closure, the densification rate will decrease with increasing density. The bulk diffusion rate of the trapped gas will limit the rate of densification. It seems reasonable that grain boundaries intersecting the gas filled pores would act as diffusion paths for the trapped gas and allow it to diffuse to the surface more rapidly than if only lattice diffusion is available.

In summarizing the mechanisms involved in sintering in many of the common metals of technological importance, lattice diffusion of vacancies with the grain boundaries acting as sinks appears to be the most important aspect of the sintering process which explains pore and sample shrinkage for these materials. Any process which hopes to improve the sinterability and densification of these materials must affect the vacancy concentration and/or the number of grain boundaries. Improved sinterability, for example, has been observed in metal powders which have been cold worked. This would increase the vacancy concentration and reduce the grain size, thereby improving the rate of sintering in the first stage but, as grain growth occurs, the advantage of fine grain size would be lost. Surface oxidation of powders has been found to improve the sinterability of some metal powders sintered in a reducing environment. This would appear perhaps to be a vacancy generation mechanism. Techniques involving the addition of other constituents to improve the sinterability of powders have been investigated. This technique is generally referred to as "activated sintering".

The process variables of technological importance involved in sintering are temperature, particle size, atmoshpere and impurities or additives. Temperature is the most easily controlled variable. Without a knowledge of the kinetics of the different processes occurring in sintering, it is difficult to predict the effects of changing temperatures on the sintering behavior. For example, if the grain growth rate is affected differently than the vacancy diffusion rate for a given temperature change, the microstructures produced at different temperatures will be affected by which mechanisms are controlling. As stated above, a fine grain size and slow grain growth rate are desirable if densification is important. If, on the other hand, spheroidization of porosity is desired with no densification, rapid grain growth and slow vacancy diffusion would be a more desirable situation. Both the overall particle size and particle size distributions affect the sintering characteristics of a given material, all other sintering parameters being held constant. Generally speaking, the finer the powder size, the more rapid the sintering. The driving force for the sintering process is the lowering of the surface energy, which accounts for this size effect. While particle size distribution effects have not been explicitly analyzed, it is well known that a spread in particle size distribution leads to better packing and increased sintered densities.

The term activated sintering has been widely used without specifically defining the term. Two general categories of activated sintering have been defined: gaseous and solid. An example of gaseous activated sintering is the intentional addition of a halogen or halide to Fe powder. This lowers the sintering temperature. Ni bonded WC is an example of solid activated sintering. In conventional activated sintering, the intentionally added constituent increases the sintering rate by liquid or vapor phase transport. In addition, homogenization of multi-phase systems can occur. These mechanisms do not involve vacancy diffusion, hence are different than those encountered in conventional sintering of metals. However, the term activated sintering could also be applied to techniques which increase the surface area or tension, thereby increasing the driving force for conventional sintering or techniques which increase vacancy diffusion. Thus, the improvement in sinterability noted above the due to surface oxidation of the particles could be termed an activated sintering mechanism. One mechanism explaining improved sinterability after oxidation has been proposed. In this explanation, it is suggested that the surfaces of metal powders have an amorphous oxide layer which inhibits bonding and which is very difficult to reduce. By oxidizing at higher temperatures, a discontinuous oxide layer is formed which is easily reduced, thereby leaving a clean surface for activated sintering.

SUMMARY OF THE INVENTION

As discussed above, existing commercially accepted methods of sintering have required the use of a closely controlled atmosphere and/or a high sintering temperature. Our improved process for sintering, which we define as a redox sintering process, overcomes the requirement for the closely controlled atmosphere and high temperatures of the prior art. The preferred sintering materials used for our process should be those used for the prior art sintered-metal oxide method; that is, metal oxides which at reduction only sustain negligible volumetric changes. For sintering, the selection would normally not include the more noble metals which do not form stable oxides and the more active metals, i,e., titanium, aluminum, etc., which have such high free energies of oxidation that they are difficult to reduce from the oxide state. Even those metals can be used for redox sintering but there would be no advantage to redox sintering compared to other sintering techniques. Metals of the class including copper, cobalt, nickel, tungsten, molybdenum, tantalum, niobium and iron and/or alloys thereof would appear to be useful. The redox sintering temperature, the number of redox cycles and the length of time for each cycle is determined by the metal being used and how readily the metal will surface oxidize and reduce.

Our process requires starting with a metal or metal compound, heating it in a furnace to a temperature at which the metal surface oxide can be readily reduced to its metallic state, and cycling the atmosphere from oxidizing to reducing (hereinafter termed redox cycling). We have found that our sintering process using redox cycling can be carried out more rapidly and at a lower temperature than if bonding were to occur strictly by thermally activated diffusion in an unchanging atmosphere as in a conventional sintering operation. Also, the quality of the atmospheres used need be only sufficient to supply a means of reducing and oxidizing the surface of the sintering component.

Our redox sintering process permits sintering to be accomplished at much lower temperatures than are possible with conventional sintering processes. It thus overcomes some of the problems associated with conventional sintering processes such as high furnace, thermocouple and energy costs.

In a test utilizing 325 mesh spherically shaped copper powder in a plurality of redox cycles at varying temperatures lower than the conventional sintering temperature of about 950° C, sintering was observed. For example, at a temperature of 300° C, some sintering was observed when the Cu was subjected to five complete redox cycles in CO and air of about four minutes each, although the sintered product had little strength. After redox sintering at 400° C, little change in particle size had occurred compared to the 300° C redox sample but surface roughening of the particles was observed. After 600° and 700° C redoxing, the amount of interparticle bonding increased as expected and smoothing of the particle surface was observed in photographs taken in a scanning electron microscope. Redox sintering of Fe and Ni was done only at 600° C in CO and air with 5 redox cycles of 4 minutes. The sintering of Fe is normally done several hundred degrees higher than this. Optical microscopy of the Fe sample showed some bonding. The Ni sample, although exhibiting some green strength, showed particle surface oxidation and little bonding when viewed optically. However, the particle shape was not spherical and was therefore not as conducive to sintering as the Cu and Fe.

These few tests indicate that our process of redox sintering should allow the sintering of many commerically important materials at significantly lower temperatures than are currently necessary while overcoming some of the present limitations imposed upon current P/M processes due to equipment, materials or design limitations.

Other tests showed that the sintered strength of Cu powder at 500° C continually increased as the powder was subjected to 1,2,4 and 8 redox cycles with a 4 minute total cycle time. The strength also increased progressively when Cu powder was subjected to 5 redox cycles at 500° C, with the cycles having a length of 2,4,8 and 16 minutes. These tests also indicate that by cycling at a faster rate and/or for a longer time, an equally sintered product can be achieved at lower temperatures.

Where air and hydrogen are used as the atmospheres for oxidizing and reducing, safety precautions dictate that the gases be changed slowly to avoid any danger of an explosion. Also, the volume of the furnace and piping introduces a delay in the ability to switch atmospheres. The change can be made much faster if one gas is evacuated before the other enters the furnace.

Interestingly, our process does not require that different gases be used. The gas need only have sufficient chemical activity to both oxidize and reduce the metal of interest, depending upon the conditions. Thus, a gas such as hydrogen, can be used to both oxide and reduce, depending on its dew point at the sintering temperature. When the hydrogen is relatively dry it will reduce the metal, and when it is made moist, such as by passing it through a bubbler, it will oxidize the metal. Obviously, the time required to cycle between wet hydrogen and dry hydrogen can be very short as compared to the time required to switch between two gases which react in an explosive manner. Fast cycling can also be obtained by using bottled argon rather than air as a source of oxygen since bottled argon normally includes about 0.1% oxygen and will not react explosively with hydrogen.

We have found that the degree of sintering increases with the number of redox cycles, with the rate of sintering being quite rapid at first and gradually tapering off. Since the number of redox cycles required to achieve densification is inversely proportional to the temperature, it is possible to utilize various combinations of redox cycles and temperatures, depending upon equipment availability and economic considerations. The time length of the redox cycle is dictated to a major extent by the time period which is required to switch from one atmosphere to the other since the surface particles in the coating react very quickly to the oxidizing or reducing gases.

The exact nature of what action takes place during our redox sintering process is not known, but considering known mechanisms associated with sintering and activated sintering, it is quite possible that one or more of six things could contribute to the activated sintering that takes place. These include:

a. Vacancy Generation Aiding Surface Diffusion

As the particulate surface is transformed back and forth from the oxide and the metal, the cyclic transformation is quite likely to produce a large number of vacant lattice sites in both the oxide and metal surface layer. This could drastically increase the rate of diffusion on the surface. Such a phenomenon would lead to rapid neck growth between particles and spheroidization of pores but no density increase.

b. Finer Grain Size

Since the furnace temperature is generally several hundred degrees lower than that normally used for sintering, grain growth rates should be markedly lowered in redox sintering. This could have several beneficial effects. Since grain boundaries have been shown to be vacancy sinks, pore shrinkage will be more rapid in a finer grained material. Finally, the finer the grain size of the final pore-free product, the higher will be the strength of the sintered body.

c. Transformation Stresses

Due to the volume difference between the metal powder and its oxide, transformation stresses will be produced in both the surface and interior of the particles after redox cycling. These residual stresses could possibly provide some of the driving force necessary to cause sintering at lower temperatures.

d. Localized Pressure Effects due to Volume Changes

As the volume change occurs during redox cycling, there will probably be a local re-ordering of particles to accommodate the expansion or contraction. This can produce localized stresses at the contact points between particles. It is possible that these stresses may be great enough to cause a pressure-type sintering mechanism to occur on a localized scale.

e. Clean Surface Welding

The phenomenon of sintering by the welding of atomically clean surfaces has been observed in metal powders as well as with larger metal objects. The removal of surface layers allows direct atomic bonding across the interface. It is conceivable that during redox cycling, the metal powder surfaces are cleaned of any barrier films which would otherwise inhibit the atomic bonding at particle contact points.

f. Exothermic Reaction

As the particle surface layer is oxidized and reduced, it is possible that the heat of reaction will be sufficient to cause localized bonding. This might, of course, change the rate of grain growth as well, thereby resulting in grain coarsening.

By examining photomicrographs taken of test specimens following varying numbers of redox cycles at different temperatures, we have concluded that sintering can be achieved in either a small or a large number of redox cycles, depending, respectively, on whether the temperature is close to, or considerably less than the standard sintering temperature for the metal oxide. As explained hereinabove, the length of redox cycle time the specimen is held in either an oxidizing or reducing atmosphere is not particularly critical as long as surface oxidation and reduction of the metal powder particles occurs.

We claim as our invention:

1. Method of sintering a powder metal body at temperatures less than the standard sintering temperature, comprising the steps of:
   - forming a quantity of powder metal particles into a body;
   - heating the body so formed in a furnace at a reduced temperature less than the standard sintering temperature of said metal,
   - repeatedly changing the atmosphere in said furnace from an oxidizing nature to a reducing nature a plurality of cycles while maintaining said reduced temperature so as to alternately oxidize and reduce the surface of the metal powder particles, said metal being selected such that said metal is one which will undergo surface oxidation and reduction at said temperature in said furnace.

2. The method of sintering set forth in claim 1 wherein said reduced temperature is the lowest temperature at which said powder metal particles will oxidize and reduce.

3. The method of sintering set forth in claim 1 wherein the atmosphere in said furnace is cycled from an oxidizing to a reducing nature at least five times.

4. The method of sintering set forth in claim 1 wherein a single gas is used to provide both an oxidizing and reducing atmosphere by varying its moisture content.

5. The method of sintering set forth in claim 1 wherein air is the source of the oxidizing atmosphere in said furnace.

6. The method of sintering set forth in claim 1 wherein argon containing about 0.1% oxygen is the source of the oxidizing atmosphere in said furnace.

7. The method of sintering set forth in claim 3 wherein the time for each oxidation and reduction cycle is about ten minutes or less.

8. Method of sintering a powder metal body formed of metal chosen form the class consisting of copper, cobalt, iron, nickel, tungsten, molybdenum, tantalum, niobium and alloys thereof comprising the steps of:
   - forming a quantity of powder metal particles into a body;
   - heating the body so formed in a furnace in an oxidizing atmosphere to a reduced temperature less than its standard sintering temperature;
   - changing the atmosphere in said furnace from an oxidizing characteristic to a reducing characteristic while maintaining said reduced temperature;
   - redox cycling the atmosphere in said furnace from an oxidizing to a reducing characteristic in a plurality of cycles at said reduced temperature to alternately oxidize and reduce the metal particles; and
   - cooling said body in a reducing atmosphere.

* * * * *